US011766876B2

(12) United States Patent
Takayama et al.

(10) Patent No.: US 11,766,876 B2
(45) Date of Patent: Sep. 26, 2023

(54) PRINTER PROVIDED WITH IRRADIATION DEVICE TO IRRADIATE PRINTING OBJECT WITH LIGHT FOR CURING INK DEPOSITED THEREON

(71) Applicant: BROTHER KOGYO KABUSHIKI KAISHA, Nagoya (JP)

(72) Inventors: Haruhisa Takayama, Nagoya (JP); Atsushi Ito, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/748,669

(22) Filed: May 19, 2022

(65) Prior Publication Data

US 2022/0379633 A1 Dec. 1, 2022

(30) Foreign Application Priority Data

May 31, 2021 (JP) ..... 2021-091904

(51) Int. Cl.
*B41J 11/00* (2006.01)

(52) U.S. Cl.
CPC ..... *B41J 11/00214* (2021.01)

(58) Field of Classification Search
CPC ..... B41J 11/00214; B41J 11/00212
See application file for complete search history.

(56) References Cited

U.S. PATENT DOCUMENTS

| | | | | |
|---|---|---|---|---|
| 10,267,563 | B2 * | 4/2019 | Kuta | F26B 3/28 |
| 2012/0120168 | A1 | 5/2012 | Kachi et al. | |

FOREIGN PATENT DOCUMENTS

| | | | |
|---|---|---|---|
| JP | 2004-508220 | A | 3/2004 |
| JP | 2006-021435 | A | 1/2006 |
| JP | 2009-226622 | A | 10/2009 |
| JP | 2010-030120 | A | 2/2010 |
| JP | 2012-051160 | A | 3/2012 |
| JP | 2012-101492 | A | 5/2012 |
| JP | 2013-166324 | A | 8/2013 |
| JP | 2013-188962 | A | 9/2013 |
| JP | 2014-030904 | A1 | 2/2014 |
| JP | 2015-063057 | A | 4/2015 |
| JP | 2020-019256 | A | 2/2020 |
| WO | 02/18148 | A | 3/2002 |

* cited by examiner

*Primary Examiner* — Bradley W Thies

(74) *Attorney, Agent, or Firm* — Kenealy Vaidya LLP

(57) ABSTRACT

A printer includes a platen, a head, and an irradiation device. The platen is configured to support a printing object and to move the printing object in a first scanning direction. The head is configured to move in a second scanning direction relative to the printing object. The second scanning direction crosses the first scanning direction. The head ejects light-curable ink onto the printing object. The irradiation device is configured to move in the second scanning direction relative to the printing object. The irradiation device irradiates light onto the light-curable ink deposited on the printing object. The irradiation device includes a first light source configured to emit light having a first wavelength, and a second light source configured to emit light having a second wavelength different from the first wavelength. The first and second light sources are disposed on one side of the head in the second scanning direction.

7 Claims, 9 Drawing Sheets

PRINTER PROVIDED WITH IRRADIATION DEVICE TO IRRADIATE PRINTING OBJECT WITH LIGHT FOR CURING INK DEPOSITED THEREON

CROSS REFERENCE TO RELATED APPLICATIONS

This application claims priority from Japanese Patent Application No. 2021-091904 filed May 31, 2021. The entire content of the priority application is incorporated herein by reference.

BACKGROUND

There has been known a conventional inkjet printer provided with a drum, a recording head, and a plurality of light source units. The drum rotates to convey sheets of paper. The recording head is arranged to face the outer circumferential surface of the drum. The recording head ejects UV-curable ink onto the paper. The light source units are disposed on the downstream side of the recording head in the paper conveying direction and are arranged along the paper conveying direction. The light source units emit ultraviolet light having mutually different peak wavelengths.

SUMMARY

However, arranging the light source units along the paper conveying direction in the conventional inkjet printer described above could increase the overall size of the inkjet printer.

In view of the foregoing, it is an object of the present disclosure to provide a printer that can suppress an increase in its overall size.

In order to attain the above and other objects, according to one aspect, the present disclosure provides a printer including a platen, a head, and an irradiation device. The platen is configured to support a printing object and to move the printing object in a first scanning direction. The head is configured to move in a second scanning direction relative to the printing object supported on the platen. The second scanning direction crosses the first scanning direction. The head is further configured to eject light-curable ink onto the printing object supported on the platen. The irradiation device is configured to move in the second scanning direction relative to the printing object supported on the platen. The irradiation device is further configured to irradiate light onto the light-curable ink deposited on the printing object supported on the platen. The irradiation device includes a first light source configured to emit light having a first wavelength, and a second light source configured to emit light having a second wavelength different from the first wavelength. The first light source and the second light source are disposed on one side of the head in the second scanning direction.

In the irradiation device according to the above aspect, the plurality of light sources having different wavelengths is disposed on one side of the head in the second scanning direction. The second scanning direction is a direction in which the head moves relative to the printing object. Accordingly, the printer can effectively utilize the space on the one side of the head to suppress an increase in the overall size of the printer.

BRIEF DESCRIPTION OF THE DRAWINGS

The particular features and advantages of the embodiment (s) as well as other objects will become apparent from the following description taken in connection with the accompanying drawings, in which.

DETAILED DESCRIPTION

Next, a printer 1 according to a first embodiment of the present disclosure will be described while referring to the accompanying drawings. The top, bottom, lower-left, upper-right, lower-right, and upper-left in FIG. 1 will denote the top, bottom, front, rear, right, and left of the printer 1 in the following description.

Figure 1:
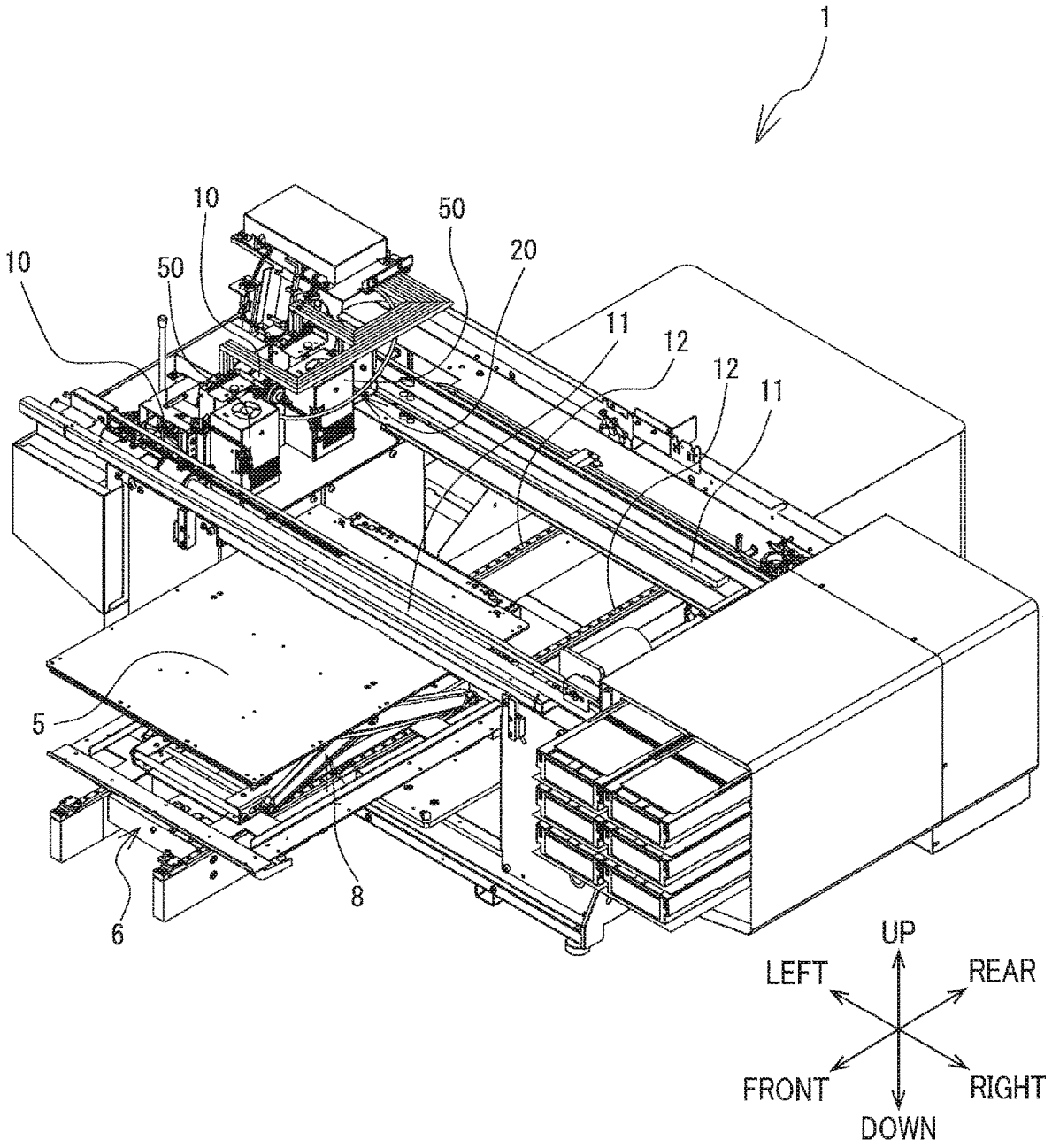
FIG. 1 is a perspective view of a printer.

First, the overall structure of the printer 1 will be described with reference to FIGS. 1 through 4. As shown in FIG. 1, the printer 1 is provided with a conveying mechanism 6, an elevating mechanism 8, and a platen 5. The conveying mechanism 6 is provided in the lower portion of the printer 1. The conveying mechanism 6 includes a pair of rails 12. The rails 12 extend in the front-rear direction and are spaced apart in the left-right direction. The front-rear direction is an example of the claimed "first scanning direction."

The elevating mechanism 8 is disposed above the conveying mechanism 6 and is supported by the pair of rails 12. The elevating mechanism 8 moves in the front-rear direction (a sub scanning direction) along the rails 12. The elevating mechanism 8 expands and contracts in the up-down direction (i.e., vertically).

The platen 5 is a plate. The platen 5 is disposed above the elevating mechanism 8 and is supported by the elevating mechanism 8. The platen 5 moves in the up-down direction by the expansion and contraction of the elevating mechanism 8 in the up-down direction. The platen 5 moves in the front-rear direction by the front-rear movement of the elevating mechanism 8. A printing object is placed on the top surface of the platen 5.

The printer 1 is provided with a pair of rails 11, and a carriage 20. The rails 11 are disposed above the platen 5. The rails 11 extend in the left-right direction and are spaced apart in the front-rear direction. The carriage 20 is disposed between the rails 11 in the front-rear direction. The carriage 20 is a plate and is supported by the rails 11. The carriage 20 moves in the left-right direction (a main scanning direction) along the rails 11. The left-right direction is an example of the claimed "second scanning direction."

The carriage 20 supports recording heads 10. The number of recording heads 10 is not limited to a specific number, but two recording heads 10 are mounted on the carriage 20 in the first embodiment. The recording heads 10 have a rectangular parallelepiped shape and are juxtaposed in the front-rear direction. The recording heads 10 are fixed to the carriage 20. The recording head 10 is an example of the claimed "head."

Figure 2:
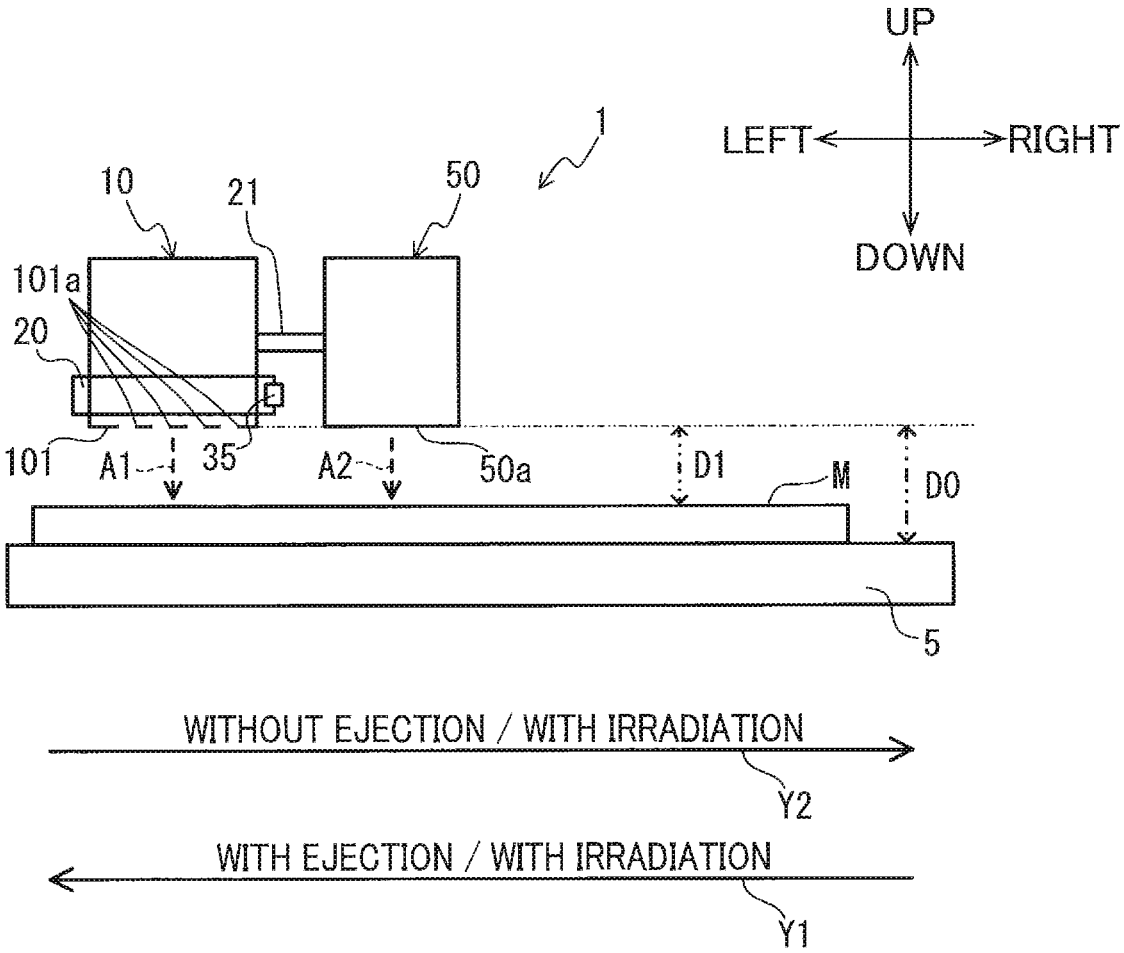
FIG. 2 is a schematic front view of the printer when an ejection distance is relatively small.
Figure 3:
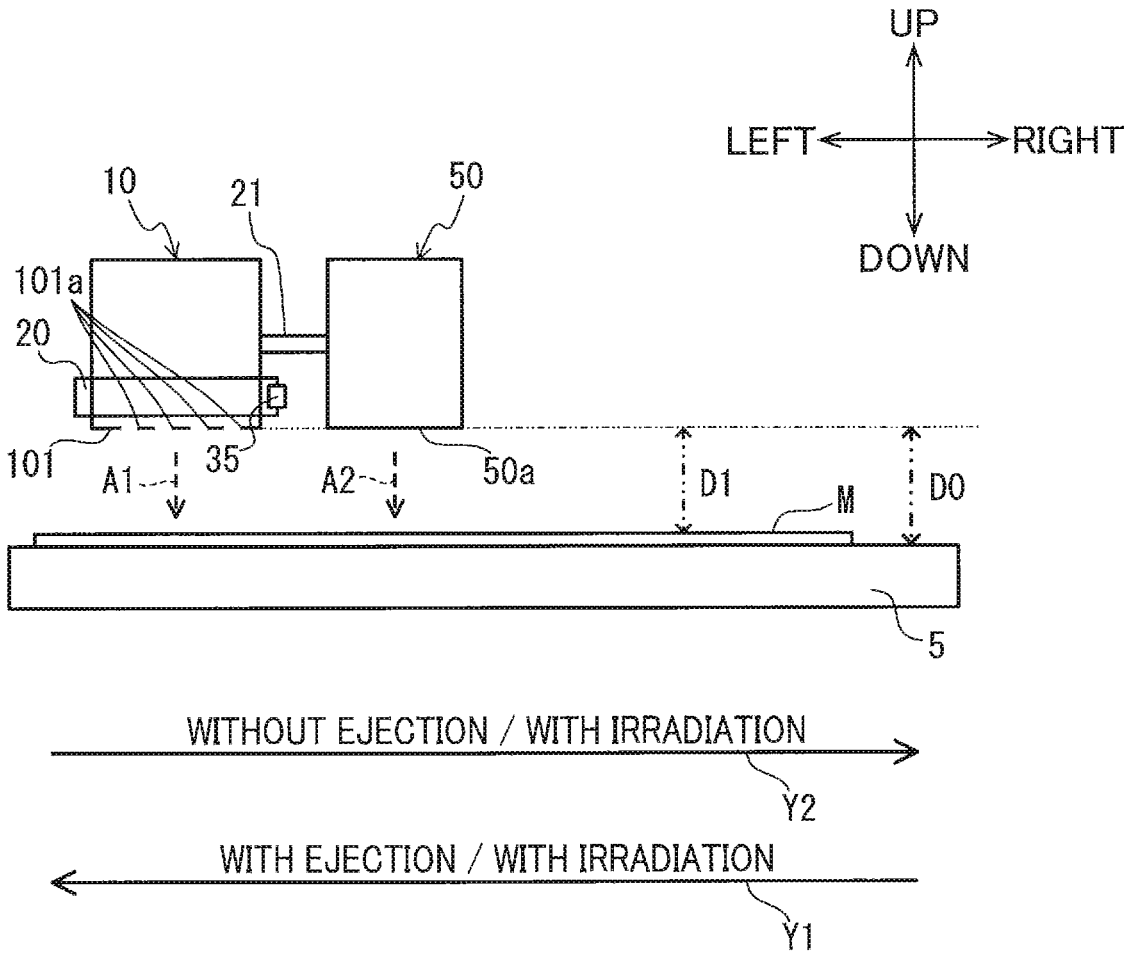
FIG. 3 is a schematic front view of the printer when the ejection distance is relatively large.

As shown in FIGS. 2 and 3, a printing object M is supported on the top surface of the platen 5. The printing object M is in the form of a plate or sheet, for example, and is composed of fabric, paper, plastic, or metal, for example. While the printer 1 has two recording heads 10 as described above, the following description will focus on one of the two recording heads 10 since the two recording heads 10 are substantially identical in structure.

The bottom surface of the recording head 10 constitutes a nozzle surface 101. The nozzle surface 101 is positioned above the platen 5 and faces the platen 5 from above. A plurality of nozzle holes 101*a* are formed in the nozzle surface 101. The recording head 10 ejects ink from the nozzle holes 101*a* downward (indicated by the arrow A1 in the drawings). As an example, the ink may be a UV-curable ink that is cured when exposed to ultraviolet light. The UV-curable ink is an example of the claimed "light-curable ink."

In the following description, the distance in the up-down direction (i.e., the vertical distance) between the nozzle surface 101 and the platen 5 will be called a "platen distance D0" and the distance in the up-down direction (i.e., the vertical distance) between the nozzle surface 101 and the printing object M will be called an "ejection distance D1." The platen distance D0 is not limited to a specific value or a specific range but may be varied over a range of 2-15 mm by expanding and contracting the elevating mechanism 8 vertically, for example. The ejection distance D1 may vary according to the platen distance D0 and the thickness of the printing object M. For example, in order to set the ejection distance D1 to the desired target distance, the user adjusts the platen distance D0 by expanding or contracting the elevating mechanism 8 according to the thickness of the printing object M.

In this example, the platen distance D0 shown in FIG. 2 is the same as the platen distance D0 shown in FIG. 3. However, the printing object M shown in FIG. 2 has a greater thickness than the printing object M shown in FIG. 3. Therefore, the ejection distance D1 in FIG. 2 is smaller than the ejection distance D1 in FIG. 3.

As shown in FIGS. 2 and 3, an irradiation device 50 is disposed on the right side of each of the recording heads 10. The recording head 10 and corresponding irradiation device 50 are coupled by a shaft 21. The shaft 21 extends in the left-right direction, with the left end of the shaft 21 coupled to the recording head 10 and the right end of the shaft 21 coupled to the irradiation device 50. The irradiation device 50 is positioned above the platen 5. The number of irradiation devices 50 is not limited to a specific number, but two irradiation devices 50 are provided in the first embodiment. Hence, the printer 1 in the first embodiment is provided with the same number of irradiation devices 50 as the number of recording heads 10.

The irradiation device 50 has a rectangular parallelepiped shape. The bottom surface of the irradiation device 50 constitutes a light source surface 50*a*. In the first embodiment, the position of the light source surface 50*a* in the up-down direction (the vertical direction) is the same as the position of the nozzle surface 101 in the up-down direction (the vertical direction). The light source surface 50*a* faces the platen 5 from above.

Figure 4:
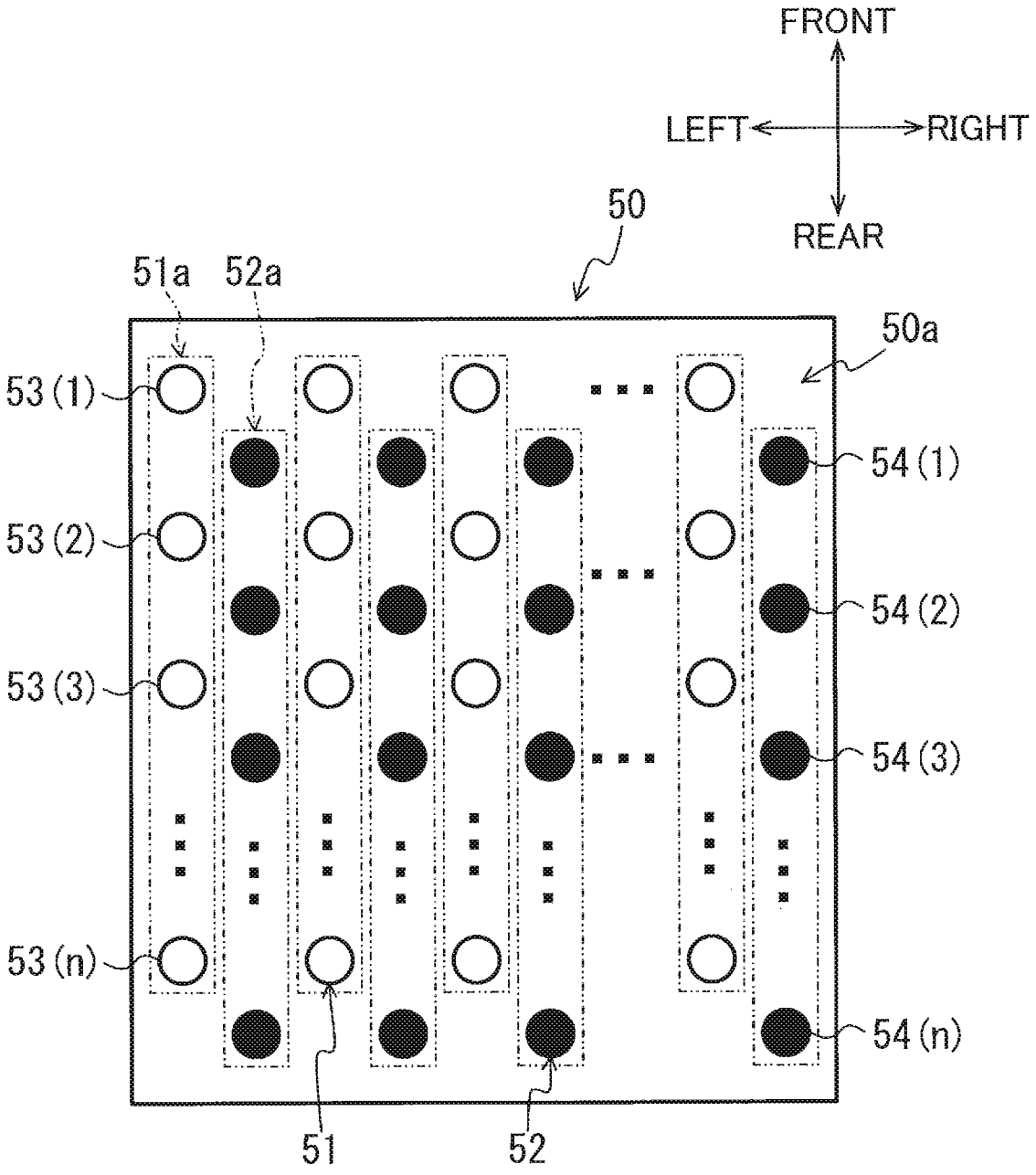
FIG. 4 is a bottom view of a light source surface of the printer 1.

As shown in FIG. 4, the irradiation device 50 is a single lamp and is provided with a plurality of light sources (a first light source 51 and a second light source 52). The first light source 51 and second light source 52 are provided on the light source surface 50*a*. The first light source 51 and second light source 52 are both ultraviolet light-emitting diodes.

The first light source 51 emits UV light having a first wavelength, and the second light source 52 emits UV light having a second wavelength. The first wavelength and the second wavelength are not limited to a specific wavelength. The second wavelength is different from the first wavelength. In the first embodiment, the second wavelength is longer than the first wavelength.

The first light source 51 is constituted by a plurality of partial light sources 53. Each partial light source 53 is depicted by a white circle in FIG. 4. The number of partial light sources 53 is not limited to a specific number. In the light source surface 50*a* shown in FIG. 4, n (where n is a natural number of 2 or greater) partial light sources 53 are aligned in the front-rear direction (the sub scanning direction) to form each row. The plurality of partial light sources 53 arranged in one row in the front-rear direction will be called a first array 51*a*. That is, in the present embodiment, the first light source 51 is constituted by a plurality of first arrays 51*a*, and each first array 51*a* is constituted by n partial light sources 53. The first array 51*a* is an example of the claimed "first light source array." The partial light source 53 is an example of the claimed "first partial light sources."

The second light source 52 is constituted by a plurality of partial light sources 54. Each partial light source 54 is depicted by a black circle in FIG. 4. The number of partial light sources 54 is not limited to a specific number. In the light source surface 50*a* shown in FIG. 4, n partial light sources 54 are aligned in the front-rear direction to form each row. The plurality of partial light sources 54 arranged in one row in the front-rear direction will be called a second array 52*a*. That is, in the present embodiment, the second light source 52 is constituted by a plurality of second arrays 52*a*, and each second array 52*a* is constituted by n partial light sources 54. The second array 52*a* is an example of the claimed "second light source array." The partial light source 54 is an example of the claimed "second partial light sources."

In the first embodiment, the first arrays 51*a* and second arrays 52*a* are arranged alternately on the light source surface 50*a* along the left-right direction. The partial light sources 53 and partial light sources 54 are arranged in an overall staggered pattern on the light source surface 50*a*.

When the first light source 51 is driven, UV light of the first wavelength is irradiated downward (indicated by the arrow A2 in the drawings) from each of the partial light sources 53. When the second light source 52 is driven, UV light of the second wavelength is irradiated downward from each of the partial light sources 54. In the first embodiment, the irradiation device 50 turns off the second light source 52 when emitting light from the first light source 51 and turns off the first light source 51 when emitting light from the second light source 52.

Figure 5A:
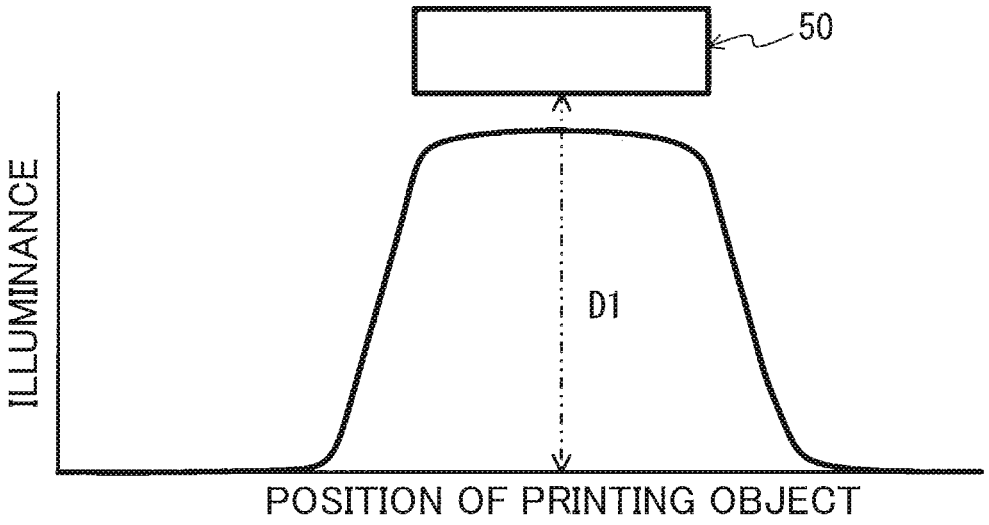
FIG. 5A is a graph showing the illuminance of light irradiated onto a printing object when the ejection distance is relatively small.
Figure 5B:
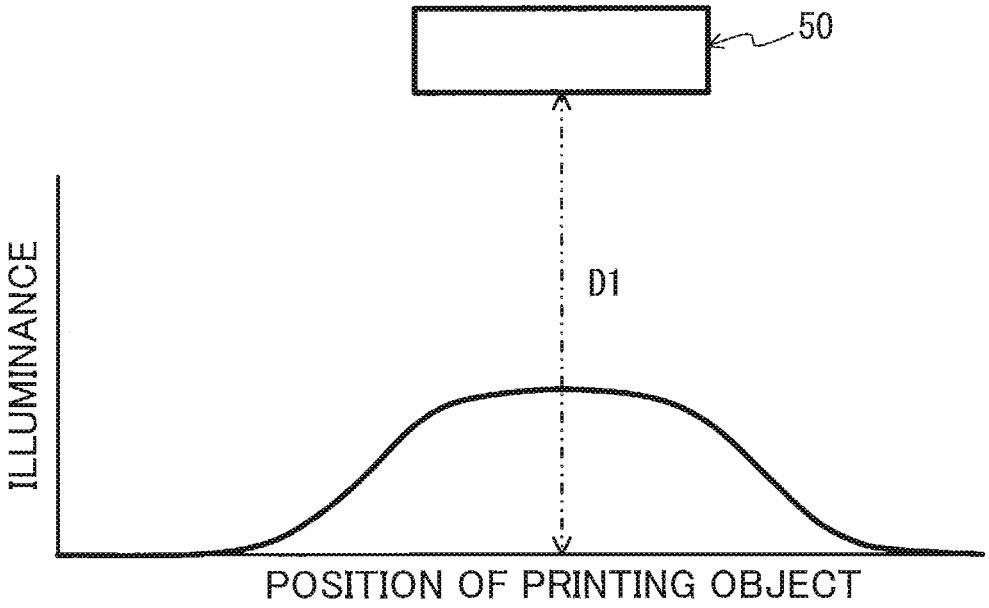
FIG. 5B is a graph showing the illuminance of light irradiated onto the printing object when the ejection distance is relatively large.

In the printer 1 described above, the ejection distance D1 may vary according to the thickness of the printing object M (see FIGS. 2 and 3). As shown in FIG. 5, the illuminance of UV light irradiated onto the printing object M decreases as the ejection distance D1 grows larger. Consequently, the printer 1 has more difficulty curing ink deposited on the printing object M when the ejection distance D1 is relatively large than when the ejection distance D1 is relatively small.

As an example, UV light having the first wavelength is more readily absorbed by the ink than UV light having the second wavelength since the first wavelength is closer to the absorption wavelength region of the ink's curing initiator. Accordingly, UV light of the first wavelength can cure the upper portion of ink deposited on the printing object more easily than UV light of the second wavelength since the upper portion of the deposited ink is closer to the irradiation device 50. On the other hand, UV light of the second wavelength is less readily absorbed by the deposited ink than UV light of the first wavelength since the second wavelength deviates from the absorption wavelength region of the ink's curing initiator. Moreover, UV light having a longer wavelength is less likely to be scattered by particles when the ink contains particles. Accordingly, UV light of the second wavelength can cure the lower portion of ink deposited on the printing object more readily than UV light of the first wavelength since the lower portion is farther from the irradiation device 50. Since the printer 1 irradiates UV light of both the first wavelength and the second wavelength, the printer 1 can sufficiently cure ink deposited on the printing object M, even when the ejection distance D1 is relatively large. Further, when using ink having a bleaching effect, which decreases absorption of UV light at the absorption wavelength of the ink's curing initiator when the ink is cured, the printer 1 can cure the lower portion of deposited ink, which portion is farther from the irradiation device 50.

One possible method of arranging the first arrays 51*a* and second arrays 52*a* on the light source surface 50*a* is to begin arranging the first arrays 51*a* sequentially from the left edge of the light source surface 50*a* toward the right and thereafter arranging the second arrays 52*a* sequentially to the right edge. However, according to the method of arranging first arrays 51*a* and second arrays 52*a* in the first embodiment, the distance between two neighboring first arrays 51*a* and the distance between two neighboring second arrays 52*a* are greater than those in the above-described possible method. This is because, in the first embodiment, one second array 52*a* is present between the two neighboring first arrays 51*a* and one first array 51*a* is present between the two neighboring second arrays 52*a*. Hence, the method of arrangement in the first embodiment can suppress the effects of heat generated by the first light sources 51 and second light sources 52 on the irradiation device 50. That is, the greater the distance between two neighboring first arrays 51*a* and the distance between two neighboring second arrays 52*a*, the smaller the rise in temperature in the partial light sources 53 or 54 that are not emitting light. Thus, this method of arrangement in the first embodiment can suppress degradation of the partial light sources 53 and 54, leading to a longer life for the device.

A possible method of arranging the partial light sources 53 and 54 in the light source surface 50*a* is to create an overall grid arrangement of partial light sources 53 and 54 on the light source surface 50*a*, for example. However, the method of arranging partial light sources 53 and 54 in the first embodiment provides greater distance in the left-right direction between neighboring partial light sources 53 and 54 than the method described above. Therefore, the method of arrangement in the first embodiment can suppress the effects of heat generated by one of the first light sources 51 and second light sources 52 on the other.

Figure 6:
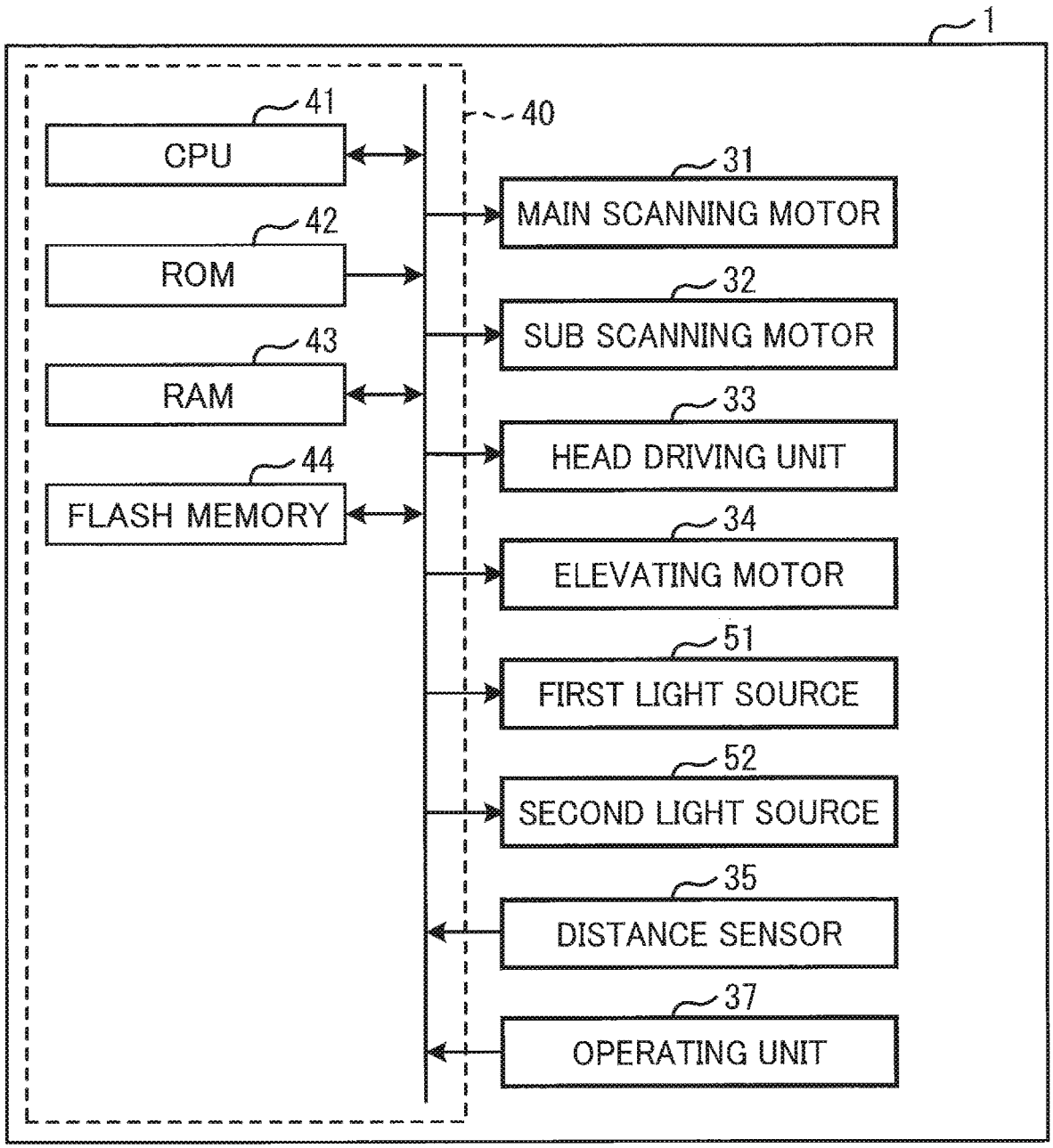
FIG. 6 is a block diagram illustrating the electrical configuration of the printer.

Next, the electrical configuration of the printer 1 will be described with reference to FIG. 6. As shown in FIG. 6, the printer 1 is provided with a control board 40. The control board 40 is provided with a CPU 41, a ROM 42, a RAM 43, and a flash memory 44. The CPU 41 is electrically connected to the ROM 42, RAM 43, and flash memory 44 and performs overall control of the printer 1.

The ROM 42 stores control programs with which the CPU 41 controls operations of the printer 1, and information and the like that the CPU 41 requires when executing various programs. The RAM 43 temporarily stores various data and the like used by the control programs. The flash memory 44 is nonvolatile memory that stores print data and the like for printing.

The CPU 41 is electrically connected to a main scanning motor 31, a sub scanning motor 32, a head driving unit 33, an elevating motor 34, the first light source 51, the second light source 52, a distance sensor 35, and an operating unit 37. The main scanning motor 31, sub scanning motor 32, head driving unit 33, elevating motor 34, first light source 51, and second light source 52 are driven under control of the CPU 41. The head driving unit 33 is configured of piezoelectric elements, heating elements, or the like. When driven, the head driving unit 33 causes the recording head 10 to eject ink from nozzle holes 101*a*.

The operating unit 37 is a touchscreen or the like that outputs information to the CPU 41 in response to user operations. By operating the operating unit 37, the user can input commands into the printer 1 such as a print command for initiating a print on the printer 1.

The distance sensor 35 is a photosensor. As shown in FIGS. 2 and 3, the distance sensor 35 is fixed to the carriage 20. The distance sensor 35 detects the ejection distance D1 and outputs detection signals to the CPU 41. Based on the detection signals received from the distance sensor 35, the CPU 41 can identify the ejection distance D1.

Next, a main process executed by the CPU 41 will be described with reference to FIG. 7. After placing a printing object M on the platen 5, the user inputs a print command into the printer 1 by operating the operating unit 37 (see FIG. 6). When a print command is inputted, the CPU 41 executes the main process by reading a control program from the ROM 42 and executing the program.

Figure 7:
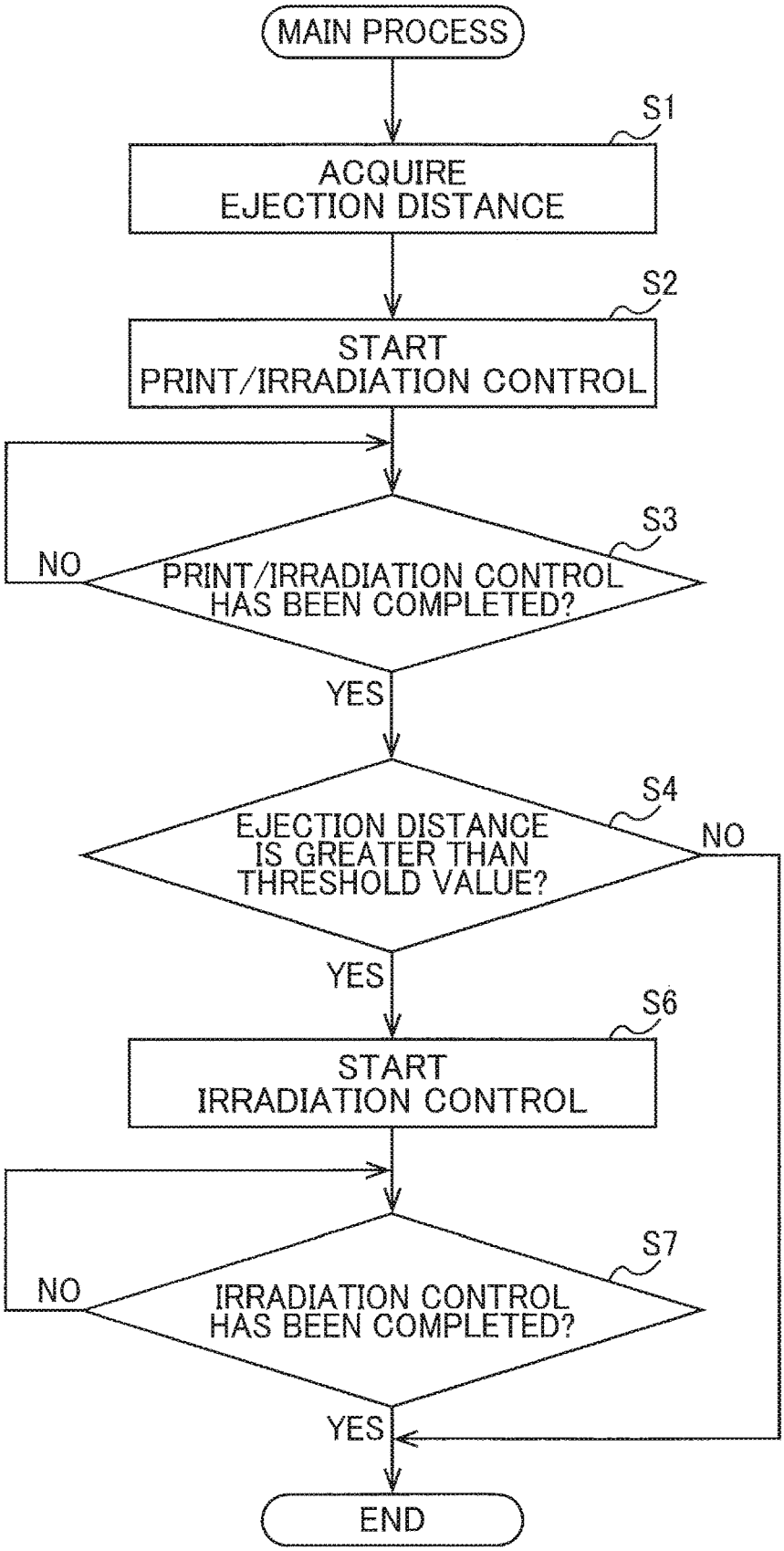
FIG. 7 is a flowchart of a main process executed by the printer.

In S1 at the beginning of the main process in FIG. 7, the CPU 41 acquires the ejection distance D1. That is, in S1 the CPU 41 performs a test scan. In a test scan, the CPU 41 drives the sub scanning motor 32 to move the platen 5 rearward until the platen 5 is positioned under the moving path (i.e., the scanning path) of the carriage 20. In this state, the CPU 41 drives the main scanning motor 31 to move the carriage 20 in the left-right direction without ejecting ink from the recording heads 10. During this operation, the distance sensor 35 detects the ejection distance D1 and outputs detection signals to the CPU 41. The CPU 41 acquires the ejection distance D1 based on the detection signal received from the distance sensor 35 when the carriage 20 is in a prescribed position relative to the platen 5 and stores this ejection distance D1 in the RAM 43.

In S2 the CPU 41 performs print/irradiation control based on the print data. In print/irradiation control, the CPU 41 drives the sub scanning motor 32 to move the platen 5 rearward until the platen 5 becomes positioned below the moving path of the carriage 20. In the first embodiment, the CPU 41 controls printing according to a method known as one-way printing.

In one-way printing, the CPU 41 drives the main scanning motor 31 to move the carriage 20 from right to left (indicated by the arrow Y1 in FIGS. 2 and 3). In this case, the CPU 41 drives the head driving unit 33 and the first light source 51. Accordingly, ink is ejected from the recording head 10 onto the printing object M supported on the platen 5, and the plurality of partial light sources 53 in the irradiation device 50 irradiate UV light of the first wavelength onto the printing object M.

The irradiation device 50 is positioned to the right of the recording head 10. Hence, UV light irradiated from the irradiation device 50 toward the printing object M (indicated by the arrow A2 in FIGS. 2 and 3) while the carriage 20 moves from right to left is incident on ink deposited on the printing object M during the same scan of the recording head 10, thereby curing the ink deposited on the printing object M.

Subsequently, the CPU 41 drives the main scanning motor 31 to move the carriage 20 from left to right (indicated by the arrow Y2 in FIGS. 2 and 3). As the carriage 20 moves in this direction, the CPU 41 drives the first light source 51 without driving the head driving unit 33 or the second light source 52. Hence, ink is not ejected from the recording head 10. However, UV light of the first wavelength is irradiated from the plurality of partial light sources 53 of the irradiation device 50 onto the printing object M supported on the platen 5.

The UV light irradiated from the irradiation device 50 onto the printing object M (indicated by the arrow A2 in FIGS. 2 and 3) while the carriage 20 moves from left to right is incident on ink that was deposited on the printing object M during the previous scan of the recording head 10. This action increases the total light intensity of IN light irradiated onto ink on the printing object M.

After a reciprocating scan of the recording head 10 in the left-right direction (i.e., a set of the above-described rightward scan and leftward scan) has been completed a prescribed number of times, the CPU 41 drives the sub scanning motor 32 to move the platen 5 a prescribed amount forward. By moving the platen 5 forward the prescribed amount each time after completing the prescribed number of reciprocating scans of the recording head 10 in the left-right direction (i.e., by repeating a process to perform a reciprocating scan of the recording head 10 in the left-right direction the prescribed number of times and then to move the platen 5 forward the prescribed amount), the CPU 41 controls printing of the printing object M on the platen 5. Note that the prescribed number of reciprocating scans may be one or may be two or greater.

In S3 the CPU 41 determines whether print/irradiation control is complete based on the print data. This determination may be made based on relationships between sizes (magnitudes) of print data and processing times for the print/irradiation control. These relationships are stored in the ROM 42. While print/irradiation control is not complete (S3: NO), the CPU 41 returns to S3. Once print/irradiation control is complete (S3: YES), the CPU 41 advances to S4.

In S4 the CPU 41 determines whether the ejection distance D1 acquired in S1 is greater than a threshold value. The threshold value is stored in the ROM 42. This threshold value is not limited to a specific value but may be a value greater than the lower limit of the platen distance D0 and smaller than the upper limit of the platen distance D0, for example.

If the ejection distance D1 is less than or equal to the threshold value (S4: NO), the CPU 41 ends the main process of FIG. 7. However, if the ejection distance D1 is greater than the threshold value (S4: YES), in S6 the CPU 41 performs irradiation control. In irradiation control, the CPU 41 drives the sub scanning motor 32 to move the platen 5 rearward until the platen 5 is positioned under the moving path of the carriage 20. Next, the CPU 41 drives the main scanning motor 31 to move the carriage 20 from right to left. While moving the carriage 20, the CPU 41 drives the second light source 52 without driving the head driving unit 33 or the first light source 51. Accordingly, ink is not ejected from the nozzle surface 101. UV light of the second wavelength is irradiated from the plurality of partial light sources 54 of the irradiation device 50 onto the printing object M supported by the platen 5. After the irradiation device 50 has completed a scan to the left, the CPU 41 drives the sub scanning motor 32 to move the platen 5 a prescribed amount forward.

Next, the CPU 41 drives the main scanning motor 31 to move the carriage 20 from left to right. At this time, the CPU 41 drives the second light source 52 without driving the head driving unit 33 or the first light source 51. Accordingly, ink is not ejected from the nozzle surface 101, but UV light is irradiated onto the printing object M on the platen 5 positioned beneath the light source surface 50*a*. After the irradiation device 50 has completed a scan to the right, the CPU 41 drives the sub scanning motor 32 to move the platen 5 a prescribed amount forward. In the first embodiment, the CPU 41 moves the platen 5 the prescribed amount forward after the irradiation device 50 completes a scan to the left or the right. However, the CPU 41 may move the platen 5 the prescribed amount forward once the irradiation device 50 has performed a reciprocating scan in the left-right direction the prescribed number of times, for example.

In S7 the CPU 41 determines whether irradiation control is complete based on the print data. This determination is made based on the relationships between the sizes of print data and processing times for irradiation control that are stored in the ROM 42. If irradiation control is not complete (S7: NO), the CPU 41 returns to S7. Once irradiation control is complete (S7: YES), the CPU 41 ends the main process in FIG. 7.

As described above in the first embodiment, the printer 1 is provided with the recording head 10, first light source 51, and second light source 52. The recording head 10 moves in the left-right direction (the main scanning direction) relative to the printing object M. The first light source 51 and second light source 52 are both disposed on the right side of the recording head 10 in the left-right direction. Accordingly, the printer 1 can effectively utilize the space on the right side of the recording head 10 to suppress an increase in the overall size of the device. The right side of the recording head 10 in the left-right direction is an example of the claimed "one side of the head in the second scanning direction."

The first light sources 51 and second light sources 52 are provided on the light source surface 50*a*. This arrangement enables the printer 1 to more effectively utilize the space on the right side of the recording head 10, suppressing an increase in the overall size of the device.

The first light source 51 includes a plurality of partial light sources 53. Each first array 51*a* is formed of n partial light sources 53 aligned in the front-rear direction. A plurality of first arrays 51*a* is provided on the light source surface 50*a*. The second light source 52 includes a plurality of partial light sources 54. Each second array 52*a* is formed of n partial light sources 54 aligned in the front-rear direction. A plurality of the second arrays 52*a* is provided on the light source surface 50*a*. The first arrays 51*a* and second arrays 52*a* are alternately arranged in the left-right direction on the light source surface 50*a*. The partial light sources 53 and partial light sources 54 are further arranged in an overall staggered pattern. In this case, the distance between the partial light source 53 and partial light source 54 that neighbor each other is greater than when the partial light sources 53 and partial light sources 54 are arranged in an overall grid pattern on the light source surface 50*a*. Therefore, in the present embodiment in which the partial light sources 53 and partial light sources 54 are arranged in a staggered pattern, heat generated by one of the first light sources 51 and second light sources 52 will have little effect on the other. Accordingly, the printer 1 can use the irradiation device 50 for a long period of time.

The irradiation device 50 irradiates light onto the printing object M while switching between light emitted from the first light source 51 and light emitted from the second light source 52. If both light emitted from the first light source 51 and light emitted from the second light source 52 were irradiated onto the printing object M simultaneously, ink deposited on the printing object M would be irradiated with UV light of excessive energy, potentially degrading the printing quality. For example, this could result in melting or alteration of the printing object caused by radiant heat from the light sources and reaction heat from curing ink, as well as a degradation of hardness or other qualities of the cured ink due to polymerization proceeding too quickly as a result of too much incident light, which could cause the curing reaction to terminate before the polymer chain of monomers in the ink is sufficiently grown. However, since the printer 1 switches between light emitted from the first light sources 51 and light emitted from the second light sources 52 so that only light emitted from one is irradiated onto the printing object M at one time, the printer 1 can reduce the possibility of a deterioration in printing quality.

From the nozzle surface 101, the recording head 10 ejects ink that is curable when irradiated by ultraviolet light. The irradiation device 50 subsequently irradiates UV light onto ink that was ejected from the nozzle surface 101 and deposited on the printing object M. Since the ink is cured with UV light, the printer 1 can utilize printing objects M of diverse materials and the like. In other words, the printer 1 can print on printing objects M on which ink is relatively difficult to fix.

Next, a printer 1 according to a second embodiment of the present invention will be described. The printer 1 according to the second embodiment differs from the printer 1 of the first embodiment in that two lamps are provided for the recording head 10. In the following description, structures having the same functions as those in the printer 1 according to the first embodiment are designated with the same reference numerals used in the first embodiment, and a description of these structures will be omitted or simplified.

Figure 8:
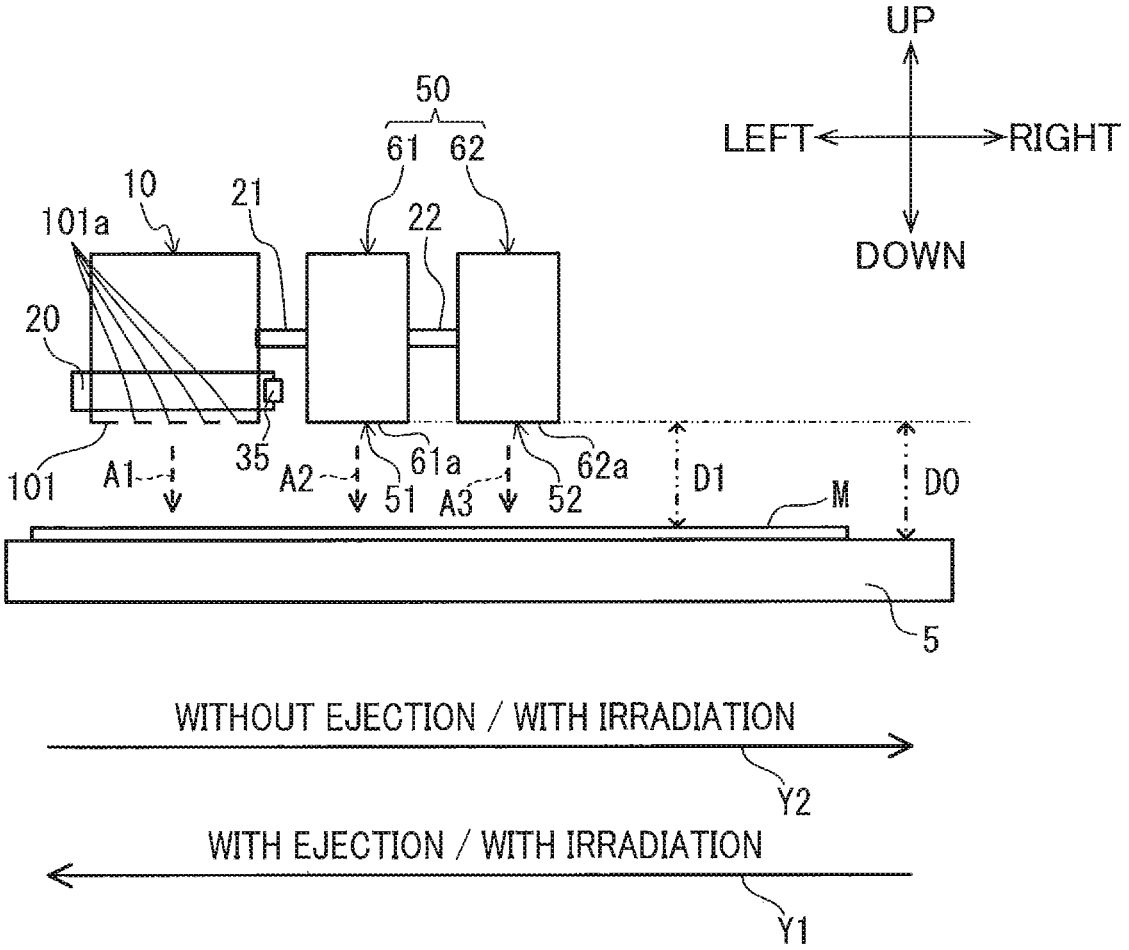
FIG. 8 is a schematic front view of a printer

As shown in FIG. 8, the irradiation device 50 is provided on the right side of the recording head 10. The irradiation device 50 is positioned above the platen 5. The irradiation device 50 is provided with a first lamp 61 and a second lamp 62. The first lamp 61 and second lamp 62 are positioned above the platen 5. The first lamp 61 is provided on the right side of the recording head 10 and is coupled to the recording head 10 by the shaft 21.

The second lamp 62 is provided on the right side of the first lamp 61. That is, the second lamp 62 is disposed on the opposite side of the first lamp 61 from the recording head 10 relative to the left-right direction. The first lamp 61 and second lamp 62 are coupled by a shaft 22. The shaft 22 extends in the left-right direction, with the left end of the shaft 22 coupled to the first lamp 61 and the right end of the shaft 22 coupled to the second lamp 62.

The first lamp 61 and second lamp 62 each has a rectangular parallelepiped shape. The first lamp 61 has a first light source surface 61*a*. The first light source surface 61*a* constitutes the bottom surface of the first lamp 61. In the second embodiment, the position of the first light source surface 61*a* in the up-down direction is the same as the position of the nozzle surface 101 in the up-down direction. The first light source surface 61*a* faces the platen 5 from above.

Figure 9A:
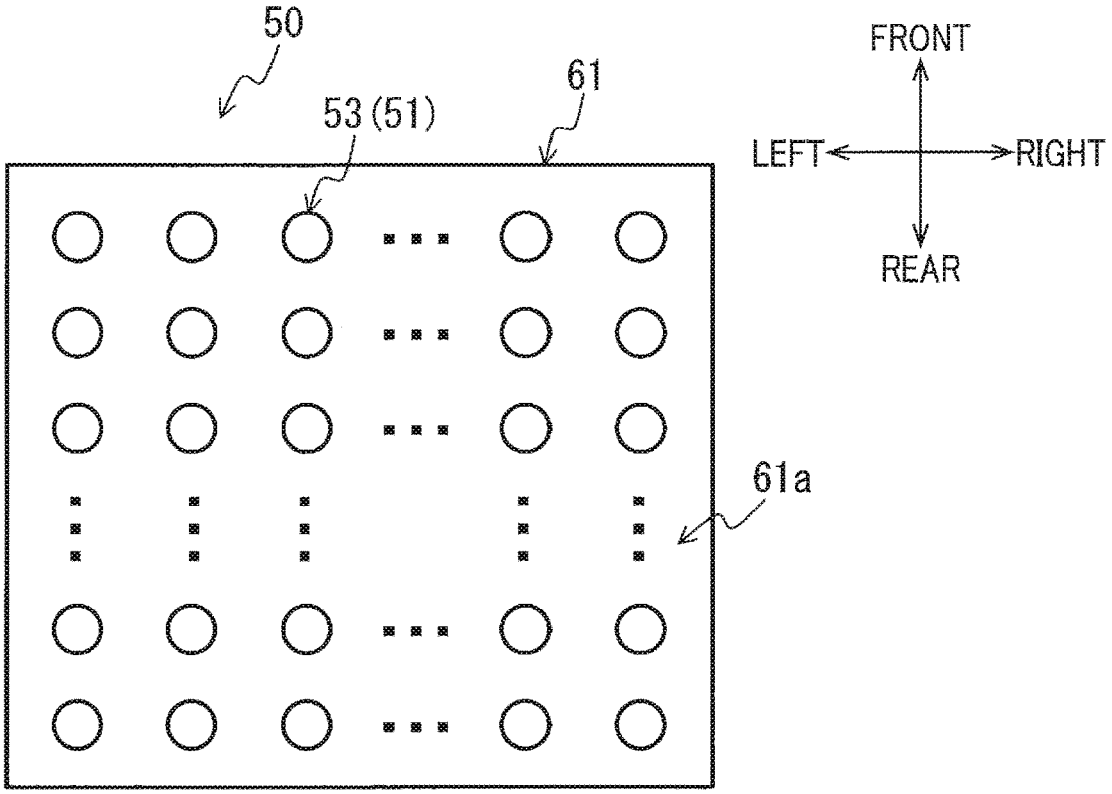
FIG. 9A is a bottom view of a first light source surface of the printer shown in FIG. 8.

The first lamp 61 is provided with a first light source 51. The first light source 51 is provided on the first light source surface 61*a*. As shown in FIG. 9A, the first light sources 51 is constituted by a plurality of partial light sources 53. The partial light sources 53 are aligned in both the front-rear direction and the left-right direction on the first light source surface 61*a*. The first light source 51 (the partial light sources 53) emits UV light having a first wavelength. When the first light source 51 is driven, UV light of the first wavelength is irradiated downward (indicated by the arrow A2 in FIG. 8) from each of the partial light sources 53.

The second lamp 62 has a second light source surface 62*a*. The second light source surface 62*a* constitutes the bottom surface of the second lamp 62. In the second embodiment, the position of the second light source surface 62*a* in the up-down direction is the same as both the position of the nozzle surface 101 in the up-down direction and the position of the first light source surface 61*a* in the up-down direction. The second light source surface 62*a* faces the platen 5 from above.

Figure 9B:
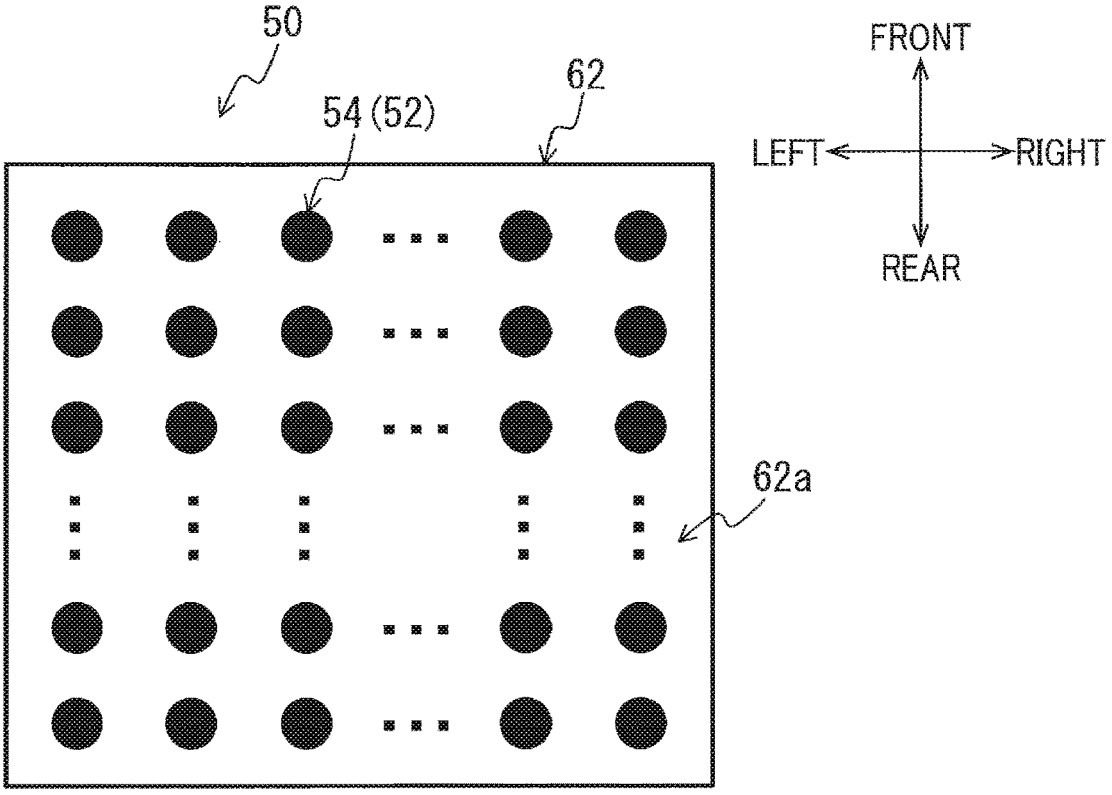
FIG. 9B is a bottom view of a second light source surface of the printer shown in FIG. 8.

The second lamp 62 is provided with a second light source 52. The second light source 52 is provided on the second light source surface 62*a*. As shown in FIG. 9B, the second light source 52 is constituted by a plurality of partial light sources 54. The partial light sources 54 are aligned in both the front-rear direction and the left-right direction on the second light source surface 62*a*. The second light source 52 (the partial light sources 54) emits UV light having a second wavelength different from the first wavelength. When the second light source 52 is driven, UV light of the second wavelength is irradiated downward (indicated by the arrow A3 in FIG. 8) from each of the partial light sources 54.

In the second embodiment, the irradiation device 50 is provided with the first lamp 61 and the second lamp 62, with the second lamp 62 disposed on the opposite side of the first lamp 61 from the recording head 10 relative to the left-right direction (the main scanning direction). The first lamp 61 and second lamp 62 are both arranged on the right side of the recording head 10. Accordingly, the printer 1 can effectively utilize space on the right side of the recording head 10, thereby suppressing an increase in the overall size of the device.

While the disclosure has been described in detail with reference to specific embodiments, it would be apparent to those skilled in the art that many modifications and variations may be made therein. Below, some variations of the embodiments will be described. The following variations can also be combined, provided that no inconsistencies arise.

In the above embodiments, the recording head 10 moves along the left-right direction. However, the recording head 10 may be a line head instead. In this case, the recording head 10 moves relative to the platen 5 in the front-rear direction by moving the platen 5.

In the embodiments described above, the irradiation device 50 irradiates ultraviolet light while moving from left to right when the carriage 20 moves from left to right. However, the irradiation device 50 may move from left to right without irradiating UV light when the carriage 20 moves from left to right.

In the embodiments described above, the printer 1 employs UV-curable light. However, the printer 1 may use ink that is cured by any type of irradiated light, such as ink cured when irradiated with visible light or infrared light. In such cases, the irradiation device 50 emits the corresponding visible light or infrared light.

In the embodiments described above, the light source surface 50*a*, first light source surface 61*a*, and second light source surface 62*a* are all arranged at the same position in the up-down direction as the nozzle surface 101. However, at least one of the light source surface 50*a*, first light source surface 61*a*, and second light source surface 62*a* may be arranged above or below the vertical position of the nozzle surface 101.

In the embodiments described above, the platen 5 and the nozzle surface 101 face each other in the up-down direction. However, the platen 5 and nozzle surface 101 may face each other in the left-right direction or in the front-rear direction. When the platen 5 and nozzle surface 101 face each other in the left-right direction or the front-rear direction, for example, the recording head 10 may move in the up-down direction relative to the platen 5.

In the embodiments described above, both the carriage 20 and the irradiation device 50 move together in the left-right direction during print/irradiation control and irradiation control, but the irradiation device 50 may move in the left-right direction relative to the carriage 20. During irradiation control, for example, the carriage 20 may remain stationary while the irradiation device 50 moves in the left-right direction. In this case, the printer 1 may be provided with a drive mechanism for moving the irradiation device 50 relative to the carriage 20 in the left-right direction.

While the irradiation device 50 in the first embodiment and the first lamp 61 and second lamp 62 in the second embodiment have rectangular parallelepiped shapes, these components may be polyhedrons having shapes other than rectangular parallelepiped shapes. For example, the irradiation device 50 in the first embodiment may be a pentahedron having a triangular shape in a side view.

In the irradiation device 50 of the first embodiment, each of the first arrays 51*a* is constituted by a plurality of partial light sources 53 that are aligned in the front-rear direction, but the partial light sources 53 may be aligned in the left-right direction instead. In this case, each of the second arrays 52*a* is constituted by a plurality of partial light sources 54 that are aligned in the left-right direction, and the first arrays 51*a* and second arrays 52*a* are alternately arranged in the front-rear direction. The partial light sources 53 and partial light sources 54 are further arranged in a staggered pattern. This arrangement obtains the same effects described in the first embodiment.

In the embodiments described above, the first light source 51 is constituted by a plurality of partial light sources 53. However, the first light source 51 may be configured of a single partial light source 53. Similarly, the second light source 52 in the embodiments described above is constituted by a plurality of partial light sources 54, but the second light sources 52 may be configured of a single partial light source 54.

In the second embodiment, the partial light sources 53 are arranged in a grid pattern on the first light source surface 61*a*, but the arrangement of the partial light sources 53 is not limited to the grid pattern. For example, the partial light sources 53 may be staggered in relation to each other. The same is true with respect to the partial light sources 54.

In S1 of the main process described above in the embodiments, the CPU 41 acquires the ejection distance D1. However, the CPU 41 may instead acquire the platen distance D0. For example, the distance sensor 35 may detect the platen distance D0. Here, the platen distance D0 may be the vertical distance (the distance in the up-down direction) between the platen 5 and any of the light source surface 50*a*, first light source surface 61*a*, and second light source surface 62*a*. Further, the ejection distance D1 may be the vertical distance (the distance in the up-down direction) between the printing object M and any of the light source surface 50*a*, first light source surface 61*a*, and second light source surface 62*a*.

The distance sensor 35 is a photosensor in the embodiments described above. However, the distance sensor 35 may be an ultrasonic distance sensor, a laser distance sensor, or the like. For example, an encoder may be provided in the elevating motor 34. The CPU 41 then determines the vertical position (the position in the up-down direction) of the platen 5 based on detection signals outputted from the encoder to identify the vertical distance (the distance in the up-down direction) between the platen 5 and nozzle surface 101 or between the platen 5 and first light source surface 61*a* or between the platen 5 and second light source surface 62*a*.

In the embodiments described above, the distance sensor 35 is provided on the carriage 20. However, the distance sensor 35 may be provided on the recording head 10, the irradiation device 50, or the platen 5. In other words, the distance sensor 35 may be disposed at any location as long as the distance sensor 35 can detect the ejection distance D1.

The method that the CPU 41 acquires the ejection distance D1 in the embodiments described above may be modified as needed. For example, the user may manually input the ejection distance D1 into the printer 1 through operations on the operating unit 37. In this case, the CPU 41 acquires the ejection distance D1 via the operating unit 37. Alternatively, the user may manually input the ejection distance D1 on an external device through operations on that device. In this case, the user operates the external device or the operating unit 37 to establish communications between the printer 1 and the external device. Through these communications, the CPU 41 acquires the ejection distance D1 from the external device. When a configuration is employed in which the CPU 41 acquires an ejection distance D1 inputted manually, the distance sensor 35 may be eliminated from the printer 1.

In the first embodiment, the threshold value used in the main process is stored in the ROM 42. However, the threshold value may be stored in the flash memory 44 and may be variable by the user. Alternatively, the CPU 41 may acquire the threshold value from an external device and may store this value in the RAM 43.

In the first embodiment, relationships between the sizes of print data and processing times for print/irradiation control or irradiation control in the main process are stored in the ROM 42. However, these relationships may be stored in the flash memory 44 and may be variable by the user. Alternatively, the CPU 41 may acquire relationships between the sizes of print data and processing times for print/irradiation control or irradiation control from an external device and may stores these relationships in the RAM 43.

What is claimed is:

1. A printer comprising:

a platen configured to support a printing object and to move the printing object in a first scanning direction;

a head configured to move in a second scanning direction relative to the printing object supported on the platen, the second scanning direction crossing the first scanning direction, the head being further configured to eject light-curable ink onto the printing object supported on the platen; and an irradiation device configured to move in the second scanning direction relative to the printing object supported on the platen, the irradiation device being further configured to irradiate light onto the light-curable ink deposited on the printing object supported on the platen, wherein the irradiation device includes a first light source configured to emit light having a first wavelength, and a second light source configured to emit light having a second wavelength different from the first wavelength, and wherein the first light source and the second light source are disposed on one side of the head in the second scanning direction.

2. The printer according to claim 1, wherein the irradiation device is a single lamp having a light source surface, and the lamp and the head are arranged in the second scanning direction, and wherein the first light source and the second light source are provided on the light source surface.

3. The printer according to claim 2, wherein the first light source is constituted by a plurality of first light source arrays, the first light source arrays are provided on the light source surface, and each of the first light source arrays is constituted by a plurality of first partial light sources arranged in one row in the first scanning direction, wherein the second light source is constituted by a plurality of second light source arrays, the second light source arrays are provided on the light source surface, and each of the second light source arrays is constituted by a plurality of second partial light sources arranged in one row in the first scanning direction, and wherein the first light source arrays and the second light source arrays are alternately arranged in the second scanning direction such that the first partial light sources and the second partial light sources are arranged in a staggered pattern on the light source surface.

4. The printer according to claim 2, wherein the first light source is constituted by a plurality of first light source arrays, the first light source arrays are provided on the light source surface, and each of the first light source arrays is constituted by a plurality of first partial light sources arranged in one row in the second scanning direction, wherein the second light source is constituted by a plurality of second light source arrays, the second light source arrays are provided on the light source surface, and each of the second light source arrays is constituted by a plurality of second partial light sources arranged in one row in the second scanning direction, and wherein the first light source arrays and the second light source arrays are alternately arranged in the first scanning direction such that the first partial light sources and the second partial light sources are arranged in a staggered pattern on the light source surface.

5. The printer according to claim 1, wherein the irradiation device includes a first lamp and a second lamp, the first lamp has a first light source surface, the second lamp has a second light source surface, and the second lamp is disposed on the opposite side of the first lamp from the head in the second scanning direction, and wherein the first light source is provided on the first light source surface, and the second light source is provided on the second light source surface.

6. The printer according to claim 1, wherein the irradiation device is further configured to switch the light irradiated onto the printing object between light emitted from the first light source and light emitted from the second light source.

7. The printer according to claim 1, wherein the light-curable ink ejected from the head is UV-curable ink that is cured when exposed to ultraviolet light, and wherein the light irradiated from the irradiation device is ultraviolet light.

* * * * *